United States Patent [19]

Powell et al.

[11] Patent Number: 4,672,675

[45] Date of Patent: Jun. 9, 1987

[54] MULTIPLE SPEAKER LOUDSPEAKER WITH CONDUCTIVE BRIDGE

[75] Inventors: Jack R. Powell, Lombard; Melvin S. Nation, Elmhurst, both of Ill.

[73] Assignee: International Jensen Incorporated, Schiller Park, Ill.

[21] Appl. No.: 766,921

[22] Filed: Aug. 19, 1985

[51] Int. Cl.[4] ..... H04R 9/02; H04R 1/02; H04R 1/24; H04R 9/06

[52] U.S. Cl. ..... 381/182; 381/87; 381/186; 381/188; 381/194; 381/205

[58] Field of Search ..... 179/115.5 PS, 115.5 R, 179/146 E, 146 R; 181/141, 144; 381/87, 88, 90

[56] References Cited

U.S. PATENT DOCUMENTS

| | | | |
|---|---|---|---|
| 1,644,605 | 10/1927 | Pavek | 179/116 |
| 2,060,098 | 11/1936 | McLachlan | 181/165 |
| 2,259,907 | 10/1941 | Olney | 179/115.5 PS |
| 2,924,290 | 2/1960 | Zuerker | 179/146 R |
| 3,342,953 | 9/1967 | Pless | 179/115.5 R |
| 3,351,719 | 11/1967 | Schoengold | 179/115.5 |
| 4,146,110 | 3/1979 | Maloney et al. | 179/115.5 PS |
| 4,365,114 | 12/1982 | Soma | 179/115.5 PS |
| 4,465,905 | 8/1984 | Nation | 179/115.5 PC |

*Primary Examiner*—Gene Z. Rubinson
*Assistant Examiner*—Danita R. Byrd
*Attorney, Agent, or Firm*—Willian Brinks Olds Hofer Gilson & Lione Ltd.

[57] ABSTRACT

A multiple speaker loudspeaker of the type comprising a larger speaker including a larger frame and at least one smaller speaker including a smaller speaker support structure is provided with first and second rigid power conductors which are rigidly mounted both to the larger frame and to the smaller speaker support structure such that the power conductors support the smaller speaker permanently in place in front of the larger speaker. These power conductors are electrically interconnected both to the smaller speaker and to power input terminals of the loudspeaker such that the first and second power conductors conduct electrical audio signals from the input terminals to the smaller speaker.

21 Claims, 16 Drawing Figures

FIG. 1
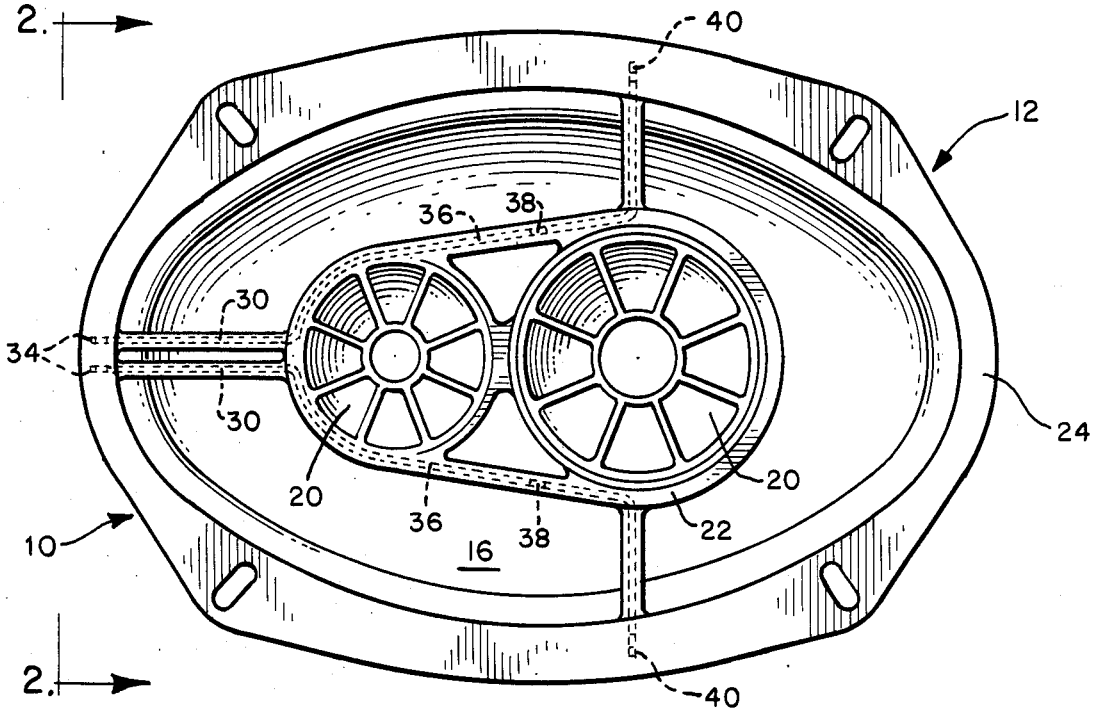
FIG. 2
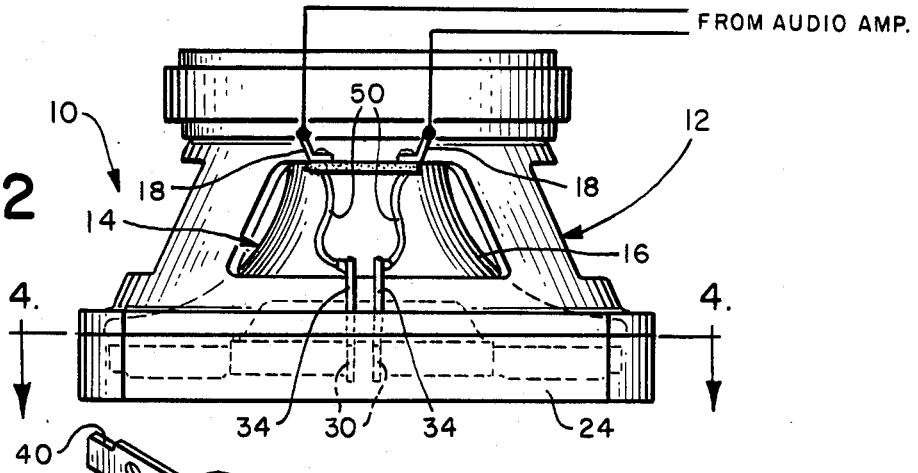
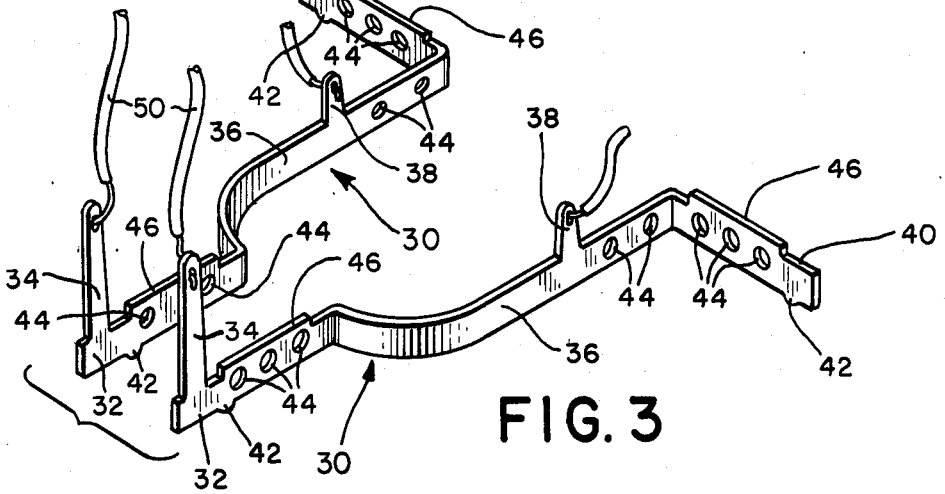
FIG. 3

FIG. 4
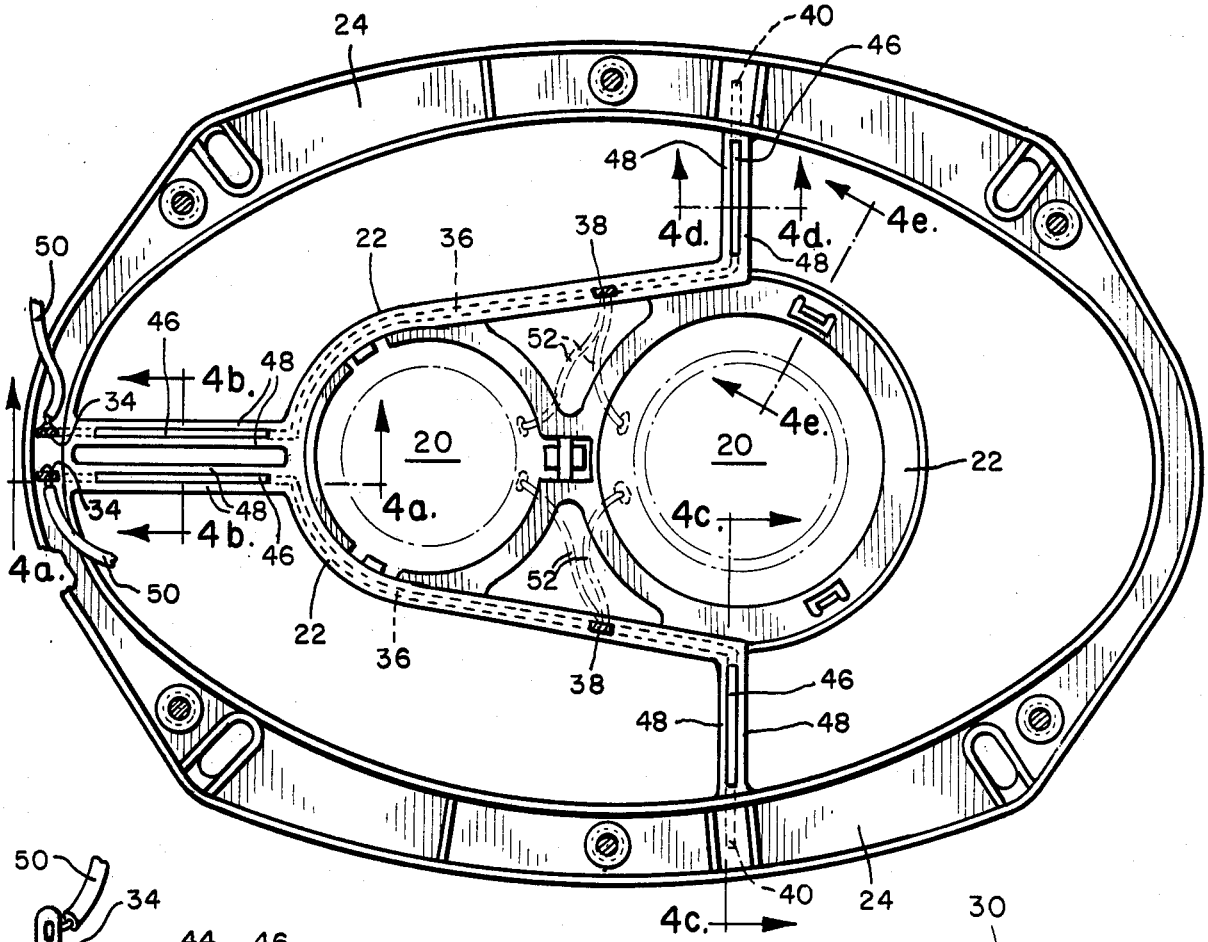
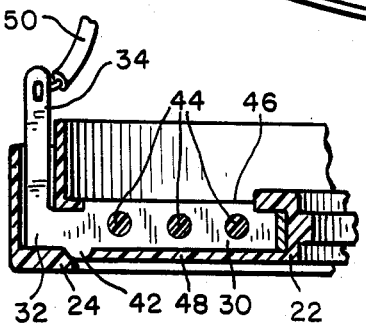
FIG. 4a
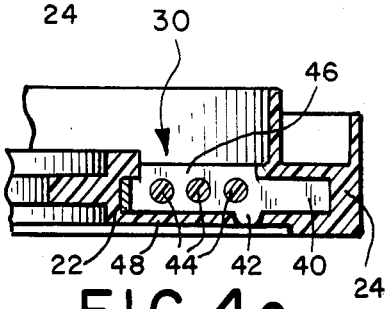
FIG. 4c
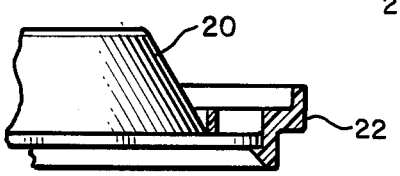
FIG. 4e
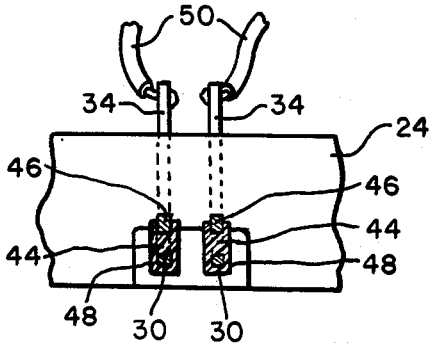
FIG. 4b
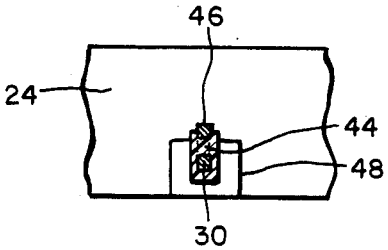
FIG. 4d FIG. 5
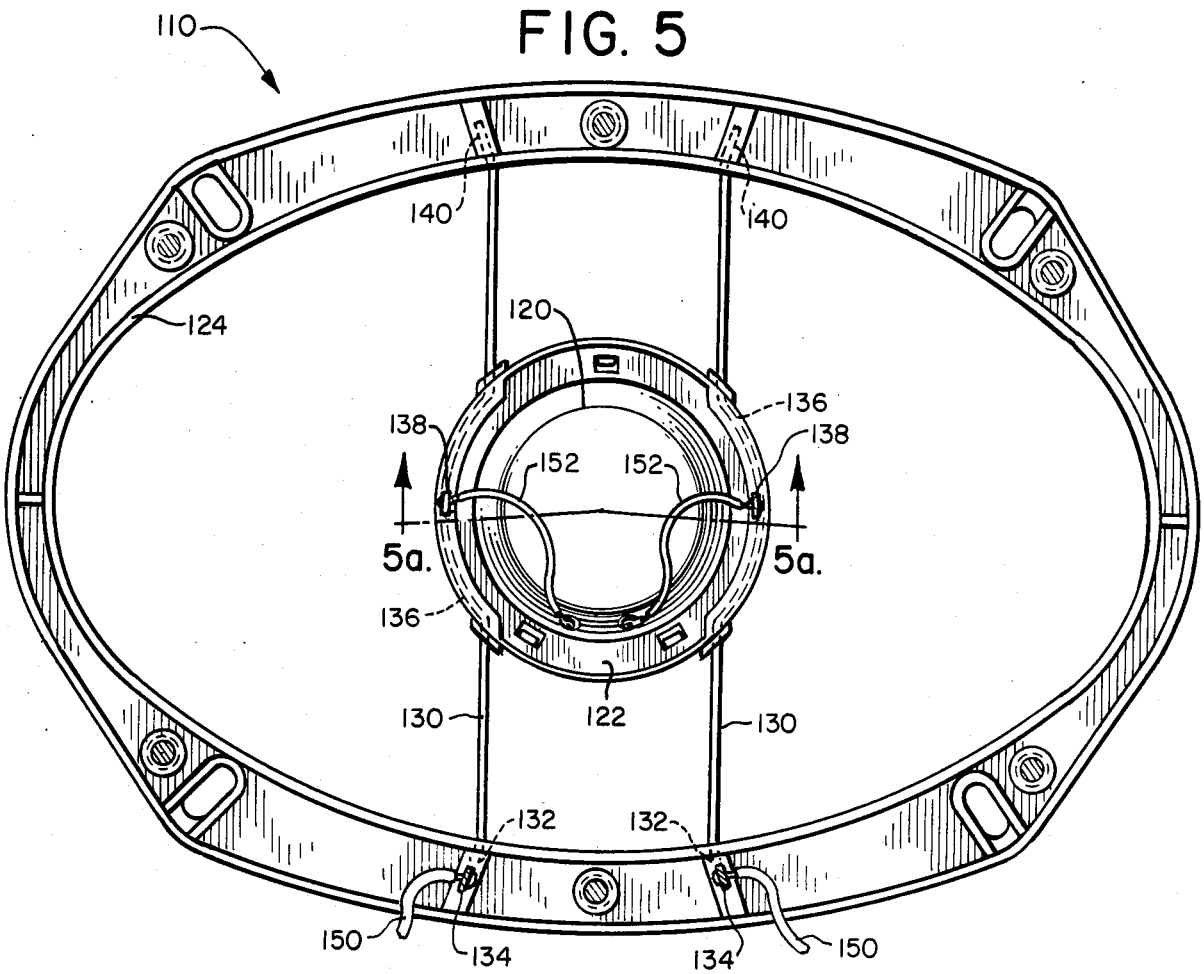
FIG. 6
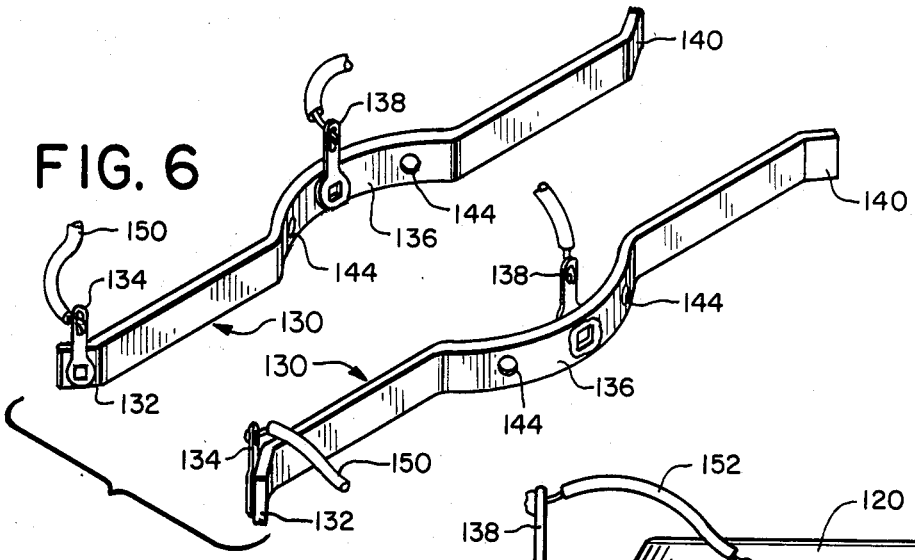
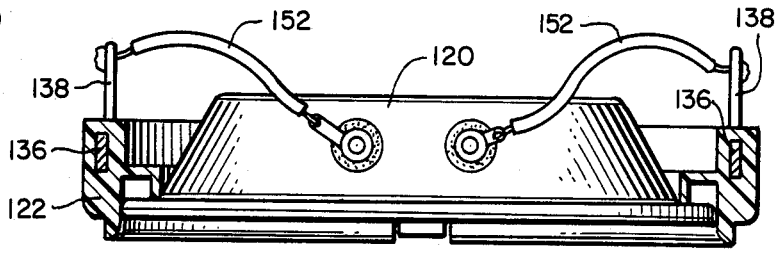
FIG. 5a

MULTIPLE SPEAKER LOUDSPEAKER WITH CONDUCTIVE BRIDGE

BACKGROUND OF THE INVENTION

The present invention relates to multiple speaker loudspeakers of the type which typically include a larger speaker and at least one smaller speaker rigidly mounted in place in front of the larger speaker, and in particular to an improved structure for conducting audio signals to the smaller speaker of such a loudspeaker.

One class of modern loudspeakers includes a number of separate speakers mounted together as a unit. A larger, low frequency speaker such as a woofer is provided, and one or two smaller high range or midrange speakers are mounted in place in front of the woofer. Such smaller speakers must be rigidly held in place in front of the larger speaker, and means must be provided for conducting electrical signals to the smaller speakers.

In the past, one approach commonly used was to mount the smaller speaker or speakers on a non-conductive bridge and to provide tinsel leads which passed through openings in the woofer diaphragm to connect the smaller speaker or speakers to power input terminals of the loudspeaker. Such separate tinsel leads provide difficulty in assembly and, if not dimensioned properly, can come into contact with adjacent structures, thereby resulting in undesirable noise.

Another approach of the prior art is illustrated in Nation U.S. Pat. No. 4,465,905, assigned to the assignee of the present invention. The Nation patent shows flexible conductors which are mounted to a plastic bridge which supports the smaller speakers in place. These flexible conductors conduct audio power to the midrange and tweeter. The arrangement described in the Nation patent avoids problems related to tinsel leads passing through the diaphragm of the larger speaker. However, nothing in the Nation patent suggests that the conductors should be formed as structural components of the bridge.

SUMMARY OF THE INVENTION

The present invention is directed to an improved bridge for a multiple speaker loudspeaker, which simultaneously supports the smaller speaker or speakers in place and conducts electrical power to the smaller speaker or speakers.

According to this invention, a loudspeaker of the type which includes a frame, a larger speaker, at least one smaller speaker, and first and second power input terminals, is provided with first and second rigid power conductors which are rigidly mounted both to the frame and to the smaller speaker such that the power conductors support the smaller speaker rigidly in place in front of the larger speaker. Means are provided for electrically interconnecting the power input terminals with respective ones of the power conductors and for electrically interconnecting the smaller speaker with the power conductors such that the power conductors conduct electrical signals from the input terminals to the smaller speaker.

This invention provides a number of important advantages. Since the bridge which supports the smaller speaker simultaneously acts as an electrical conductor for audio signals, separate wires are eliminated. In many applications the present invention provides a loudspeaker with fewer component parts which is simpler to assemble and which completely eliminates problems associated with tinsel leads passing through the diaphragm of the loudspeaker. Furthermore, this invention makes possible many unusual and attractive designs for the bridge. Because the bridge is formed of a conductive metal, it can, if desired, be made relatively thin in cross-section. In this way, relatively small, compact bridge designs can be substituted for conventional bridge designs, such as those shown in the above referenced Nation patent. As a corollary to this point, because metal typically provides greater strength for a given cross-section as compared with conventional plastics, the present invention provides improved support for the smaller speaker as compared with a plastic bridge of comparable section.

The invention itself, together with further objects and attendant advantages, will best be understood by reference to the following detailed description, taken in conjunction with the accompanying drawings.

BRIEF DESCRIPTION OF THE DRAWINGS

FIG. 1 is a front elevational view of a loudspeaker which incorporates a first preferred embodiment of this inventio.

FIG. 2 is a side elevational view of the loudspeaker of FIG. 1 as seen from line 2—2 of FIG. 1.

FIG. 3 is a perspective view of the two bridge components of the embodiment of FIGS. 1–2.

FIG. 4 is a sectional view taken along line 4—4 of FIG. 2.

FIG. 4*a* is a sectional view taken along line 4*a*—4*a* of FIG. 4.

FIG. 4*b* is a sectional view taken along line 4*b*—4*b* of FIG. 4.

FIG. 4*c* is a sectional view taken along line 4*c*—4*c* of FIG. 4.

FIG. 4*d* is a sectional view taken along line 4*d*—4*d* of FIG. 4.

FIG. 4*e* is a sectional view taken along line 4*e*—4*e* of FIG. 4.

FIG. 5 is a sectional view corresponding to FIG. 4 of a second preferred embodiment of this invention.

FIG. 5*a* is a sectional view taken along line 5*a*—5*a* of FIG. 5.

FIG. 6 is a perspective view of two components of the bridge of the embodiment of FIG. 5.

DETAILED DESCRIPTION OF THE PRESENTLY PREFERRED EMBODIMENTS

Figure 7:
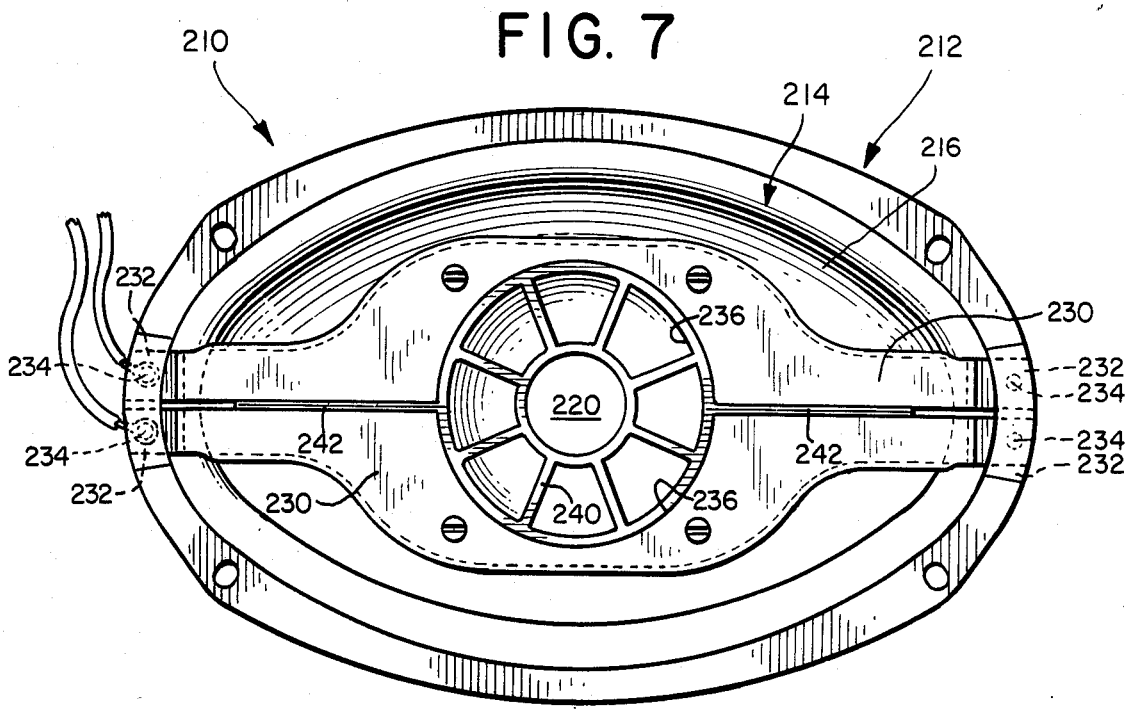
FIG. 7 is a front elevational view of a loudspeaker which incorporates a third preferred embodiment of this invention.

Turning now to the drawings, FIGS. 1–4*e* show various views of a loudspeaker 10 which incorporates a first preferred embodiment of this invention. This loudspeaker 10 includes a larger speaker 14 and two smaller speakers 20. The larger speaker 14 in this embodiment acts as a woofer, and includes a woofer diaphragm or cone 16. The larger speaker 14 is mounted in a larger frame or basket 12 which includes a front annular ring or pad ring 24. The annular ring 24 is rigidly mounted in place to the remainder of the frame 12, as for example by means of threaded fasteners, snap lock fingers, adhesives, or the like. The smaller speakers 20 are rigidly mounted to a smaller speaker support structure 22. The manner in which the smaller speakers 20 are secured to the support structure 22 is not critical to this invention, and fasteners, adhesives or snap fingers can be used, for example. As best shown in FIG. 2, the loudspeaker 10 includes a pair of power input terminals 18. Audio voltages applied to the power input terminals 18 are used to power both the larger speaker 14 and the smaller speakers 20.

The loudspeaker 10 includes two power conductors 30 which cooperate to form a bridge which supports the support structure 22 in place in the ring 24. FIG. 3 shows a perspective view of these power conductors 30. As shown in FIG. 3, each of the power conductors 30 defines a first end 32, which defines a lug 34, and an intermediate section 36, which also defines a lug 38. Each of the power conductors 30 defines a pair of tabs 42, one near each end 32,40. In addition, each power conductor 30 defines a pair of ribs 46, each positioned near a respective end of the power conductor 30 on a side opposite the respective tab 42. Each power conductor 30 defines an array of openings or apertures 44 extending completely through the power conductor.

In this embodiment the ring 24 and the support structure 22 are injection molded in a single molding operation, and the power conductors 30 are insert molded such that the intermediate sections 36 are embedded in the support structure 22 and the ends 32,40 are embedded in the ring 24. Thus, the power conductors 30 are rigidly mounted to the support structure 22 at the intermediate sections 36, and the power conductors 30 are rigidly mounted to the ring 24 at their ends 32,40. The power conductors 30 serve to support the support structure 22 and therefore the smaller speakers 20 rigidly in place in front of the woofer diaphragm 16 and to prevent the support structure 22 from moving or vibrating excessively in use.

As best shown in FIG. 4, the two lugs 34 on the power conductors 30 are positioned adjacent to one another. As shown in FIG. 2, these two lugs 34 are each connected, as for example by solder, to wires 50, which are in turn connected to respective ones of the power input terminals 18. In addition, means such as wires 52 soldered to the lugs 38 are provided to interconnect the smaller speakers 20 with the intermediate sections 36 of the conductors 30.

As best shown in FIGS. **4*b* and 4*d*, in the region between the ring 24 and the support structure 22, the power conductors 30 are surrounded by a plastic layer 48 on three sides. This plastic layer 48, which is formed in the insert molding operation, acts as an electrical insulator to prevent accidental shorting between the conductors 30. In addition, this layer 48 provides cosmetic advantages by ensuring that the power conductors 30 present an appearance similar in color and texture to that of the support structure 22 and the ring 24**.

A number of features of the power conductors 30 have been provided to ensure that each power conductor 30 is positioned properly to achieve the desired distribution of the plastic layer 48 on three sides of the power conductor 30. The ribs 46 are positioned to fit into corresponding troughs in one side of the injection mold (not shown). These ribs 46 therefore cooperate with the mold to position the power conductors 30 positively in the desired location. A second feature is the apertures 44 which allow plastic to move from one side of the power conductor to the other during the molding operation, thereby reducing the tendency of the conductor 30 to be bent or displaced during the molding operation. Once the molding operation has been completed, the apertures 44 allow the plastic layer 48 on both sides of the conductors 30 to bond together to provide a stronger, more durable assembly. A third feature is the tabs 42 which are provided with a reduced cross-section and are intended to deform during the molding operation. When the two sides of the mold close, the tabs 42 are deformed, thereby ensuring that the conductors 30 are positioned properly.

The thickness of the plastic layer 48 around the conductors 30 is in this embodiment in the neighborhood of 0.020 inches. In the conventional manner, the outer surfaces of the plastic layer 48 are tapered to facilitate removal of the finished structure from the mold.

In order to further clarity this preferred embodiment, the following details of construction are provided. It should, however, be understood that these details of construction are merely exemplary, and in no way limit this invention. In this embodiment, the conductors 30 are formed from cold rolled steel and have a thickness of about 0.031 inches. The ring 24, the support structure 22 and the plastic layer 48 in this embodiment are formed from a high temperature ABS plastic, such as that marketed by Monsanto as Cadon 127. The lugs 34,38 can be integrally formed in the power conductors 30 or can be attached thereto. In the event the lugs 34,38 are formed as separate pieces, they can be secured to the conductors 30 in any suitable manner, such as by welding, riveting, or crimping in place. The pesent invention can be used with the complete range of speakers, and the details of construction of the larger speaker 14 and the smaller speakers 20 do not form a part of this invention. For this reason, the speakers will not be described in greater detail here. Similarly, the means for connecting the lugs 38 to the smaller speakers 20 may also include any one of a large number of conventional arrangements. For example, crossover networks can be provided if desired, depending on the application. Similarly, the present invention can be used with a wide variety of means for interconnecting the conductors 30 and the power input terminals 18. Conventional wires can be used as shown in FIG. 2, or alternately connectors of the type described in the above identified Nation patent can be used if desired.

The embodiment of FIGS. 1 through **4*e* utilizes the conductors 30 both to transmit audio power signals to the smaller speakers 20 and to support the smaller speakers 20 in place over the larger speaker 14 in a rigid, vibration-free manner. In this way, the number of components is reduced and assembly is remarkably simplified. The plastic layer 48 does not provide any significant degree of support to the smaller speakers 20, and the power conductors 30 would support the smaller speaker 20 properly, even if the plastic layer 48 were removed. The plastic layer 48 acts as an electrical insulator for the conductors 30**.

Turning now to FIGS. 5–6, these figures illustrate portions of a loudspeaker 110 which incorporates a second preferred embodiment of this invention. FIG. 5 shows a sectional view of an outer ring 124 which is similar to the ring 24 of FIG. 4. The remaining portions of the loudspeaker 110 are not shown, but are similar to the loudspeaker 10 of FIGS. 1 and 2 with respect to the larger speaker 14 and the frame 12.

As shown in FIGS. 5–6, the loudspeaker 110 includes a smaller speaker 120 which is mounted to a support structure 122. A pair of power conductors 130 are provided, and FIG. 6 shows a perspective view of these power conductors 130. Each of the power conductors 130 includes first and second ends 132,140 and an intermediate section 136. First and second lugs 134,138 are mounted on the first end 132 and the intermediate section 136, respectively. An array of apertures 144 are formed in the conductor 130.

In this embodiment the ring 124 and the support structure 122 are injection molded together in a single-step operation in which the power conductors 130 are insert molded in place. The first and second ends 132,140 of the power conductors 130 are embedded in the ring 124, and the intermediate sections 136 of the conductors 130 are embedded in the support structure 122. Thus, the power conductors 130 rigidly mount the support structure 122 in place with respect to the ring 124. In a manner substantially identical to that of the loudspeaker 10 of FIGS. 1 through 4*e*, the power conductors 130 simultaneously transmit audio electrical signals to the smaller speaker 120 and rigidly support the smaller speaker 120 in place.

In this embodiment, the portions of the conductors 130 extending between the ring 124 and the support structure 122 are exposed, and are not covered with a plastic layer in the manner of the embodiment of FIGS. 1 through 4*e*. In this embodiment, at least the exposed portions of the power conductors 130 are covered with a zinc dichromate coating, conventionally known as "black zinc" in the industry.

Figure 8:
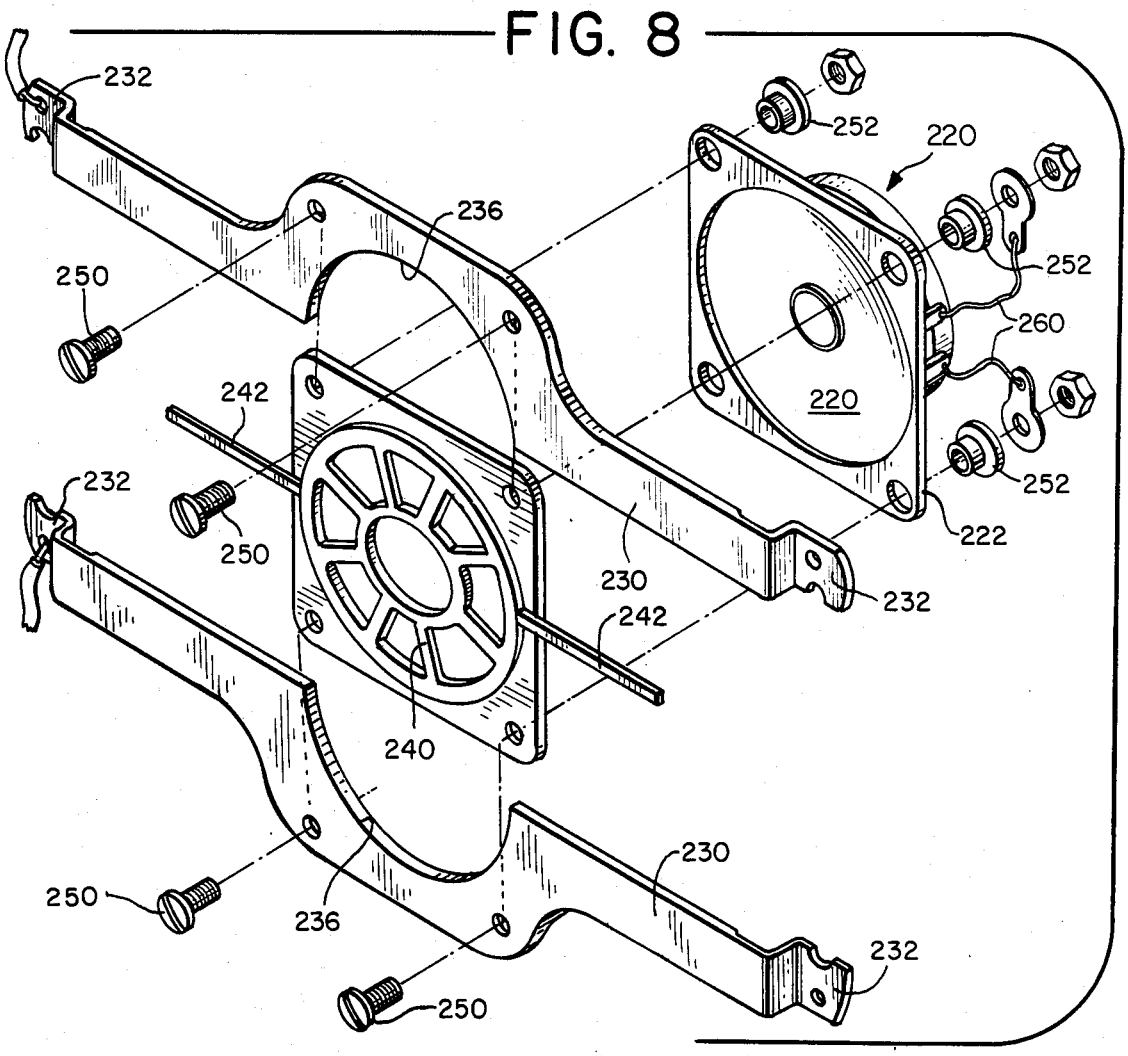
FIG. 8 is an exploded perspective view of the bridge and smaller speaker of the embodiment of FIG. 7.

FIGS. 7 and 8 relate to a third preferred embodiment of this invention. As shown in FIG. 7, a loudspeaker 210 includes a larger frame 212, which supports a larger speaker 214 which in turn includes a woofer diaphragm 216. A smaller speaker 220 is provided which in turn includes a smaller speaker support structure 222.

In this embodiment, a bridge is provided which includes two bridge elements 230. Each of these bridge elements 230 includes a pair of opposed ends 232 which are rigidly mounted in place to the larger frame 212, as for example by fasteners 234. Each of the bridge elements 230 defines a semi-circular opening 236 which is centrally positioned with respect to the woofer diaphragm 216.

As best shown in FIG. 8, a grille 240 is provided which includes a pair of elongated ribs 242. Preferably, the grille 240 is injection molded from a suitable, electrically insulating plastic.

The grille 240 and the smaller speaker 220 are rigidly secured to the bridge elements 230 by means of threaded fasteners 250. Insulating washers 252 are provided in the event the support structure 222 is formed of a conductive material in order to isolate the support structure 222 from the bridge elements 230. A pair of wires 260 are used to interconnect the smaller speaker 220 with respective ones of the fasteners 250 which are in turn in electrical contact with respective ones of the bridge elements 230. The bridge elements 220 are in turn electrically interconnected with power input terminals (not shown) of the loudspeaker 210. For example, the fasteners 234 can be used to conduct electrical power to the bridge elements 230.

In the loudspeaker 210 the bridge elements 230 simultaneously perform two functions. They rigidly support the smaller speaker 220 in place over the larger speaker 214, and they conduct audio power signals to the smaller speaker 220. The ribs 242 of the grille 240 maintain the two bridge elements 230 out of contact with one another, thereby insulating the two bridge elements 230 from one another. In this embodiment, the bridge elements 230 are formed of a suitable sheet metal which is itself electrically conductive.

Figure 9:
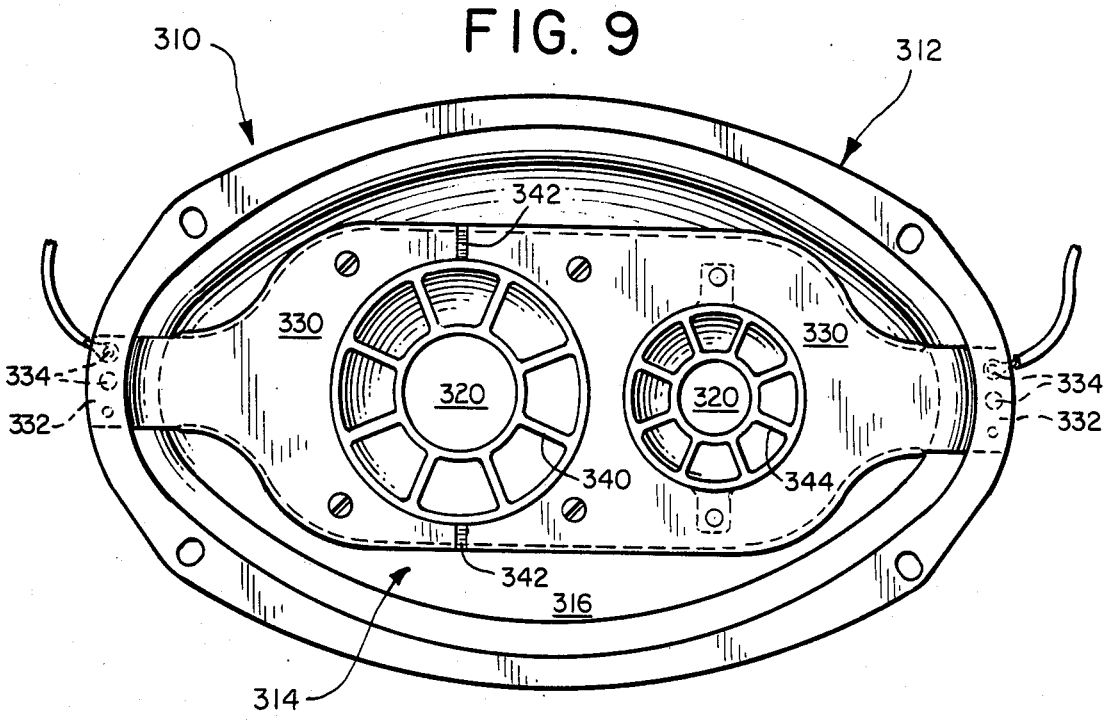
FIG. 9 is a front elevational view of a loudspeaker which incorporates a fourth preferred embodiment of this invention.
Figure 10:
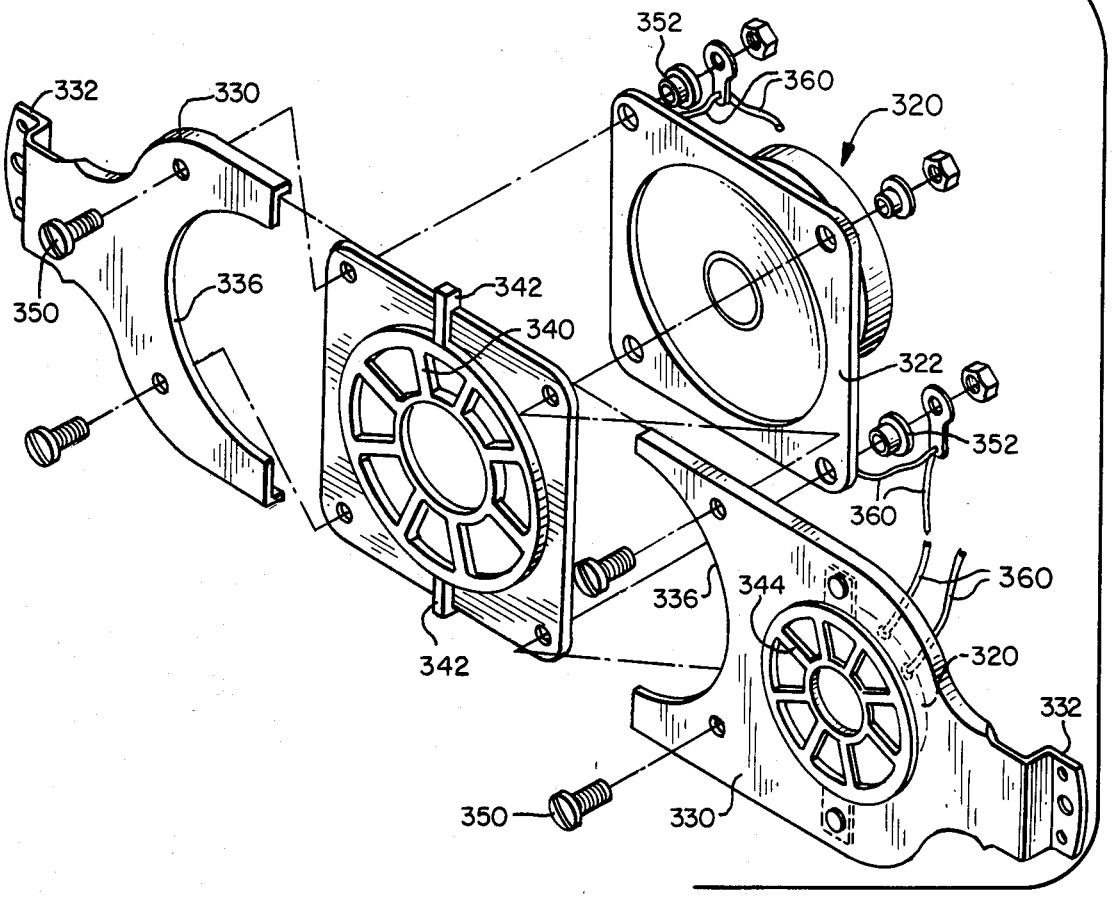
FIG. 10 is an exploded perspective view of the bridge and smaller speakers of the embodiment of FIG. 9.

FIGS. 9 and 10 provide two views of a loudspeaker 310 which incorporates a fourth preferred embodiment of this invention. This loudspeaker 310 includes a frame 312 which supports a larger speaker 314 including a woofer diaphragm 316. A pair of smaller speakers 320 each include a respective smaller speaker support structure 322.

In this embodiment, two bridge elements 330 are provided, each of which includes a first end 332 which is rigidly connected to the larger frame 312, as for example by fasteners 334. Each of the bridge elements 330 defines a semi-circular opening 336. A larger grille 340 is provided, which defines a pair of collinear ribs 342. This larger grille 340 is mounted by fasteners 350 to opposed ends of the bridge elements 330 and to one of the smaller speakers 320. As before, the grille 340 serves to insulate the two bridge elements 330 from one another. When necessary, insulating washers 352 are used to prevent undesired connections with the bridge elements 330. A smaller grille 344 is provided over the other of the smaller speakers 320, which is held in place by fasteners. Electrically conductive wires 360 are connected to respective ones of the fasteners 350 and to respective terminals on the speakers 320 in order to interconnect the smaller speakers 320 with the bridge elements 330.

As in the preceding embodiments, the bridge elements 330 are connected by means (not shown) with power input terminals of the loudspeaker 310. The bridge elements 330 simultaneously support the smaller speakers 320 in place and conduct audio power signals to the smaller speakers 320. As in the embodiment of FIGS. 10 and 11, the bridge elements 330 are preferably formed of a conductive sheet metal.

From the foregoing, it should be apparent that several examples of an improved bridge for a multiple speaker loudspeaker have been disclosed, all of which simultaneously support the smaller speaker or speakers in place and conduct audio power signals to the smaller speaker or speakers.

Of course, it should be understood that a wide range of changes and modifications can be made to the preferred embodiments described above. For example, the power conductors can, if desired, be embedded as a support element in a non-conductive bridge. It is therefore intended that the foregoing detailed description be regarded as illustrative rather than limiting, and that it be understood that it is the following claims, including all equivalents, which are intended to define the scope of this invention.

We claim:

1. In a loudspeaker of the type comprising a first, larger speaker including a frame, at least one second, smaller speaker, and first and second power input terminals, the improvement comprising:

first and second rigid power conductors;

first means for rigidly mounting the first and second conductors to the frame;

second means for rigidly mounting the first and second conductors to the smaller speaker such that the first and second conductors rigidly support the smaller speaker in place in front of the larger speaker;

means for electrically interconnecting the first and second power input terminals and the first and second conductors, respectively; and means for electrically interconnecting the first and second conductors and the smaller speaker such that the first and second conductors conduct electrical signals from the first and second power input terminals to the smaller speaker.

2. The invention of claim 1 wherein the first and second conductors provide the only structural interconnection between the frame and the smaller speaker.

3. The invention of claim 1 wherein each of the power conductors defines first and second end sections rigidly secured to the frame and an intermediate section rigidly secured to the smaller speaker such that each of the first and second power conductors forms a respective pair of structural supporting elements extending between the frame and the smaller speaker.

4. The invention of claim 3 wherein the structural supporting elements extend generally radially away from the smaller speaker.

5. The invention of claim 1 wherein the frame defines a plane, wherein each of the power conductors comprises a respective bar having a thickness measured parallel to the plane and a depth measured transverse to the plane, and wherein the depth is greater than the thickness.

6. The invention of claim 1 wherein each of the power conductors defines a first end mounted to the frame and a second end mounted to the smaller speaker.

7. The invention of claim 1 wherein the second mounting means comprises a smaller speaker support structure, and wherein the first and second conductors are insert molded in the smaller speaker support structure.

8. The invention of claim 7 wherein the conductors are insert molded in the larger speaker frame and wherein at least a front portion of the conductors is covered with a molded plastic layer.

9. The invention of claim 1 wherein the conductors and the first and second means provide sufficient support to the smaller speaker to prevent excessive vibration of the smaller speaker.

10. The invention of claim 1 wherein the means for connecting the power input terminals to the conductors comprises first and second contacts, each mounted on a respective one of the conductors, and wherein the first and second contacts are located adjacent to one another.

11. In a loudspeaker of the type comprising a first, larger speaker including a larger frame, a second, smaller speaker including a smaller speaker support structure, and first and second power input terminals, the improvement comprising:

first and second power conductors, each comprising a first end section insert molded in the larger frame, a second end section insert molded in the larger frame, an intermediate section insert molded in the support structure, a first support section extending between the first end section and the intermediate section, and a second support section extending between the second end section and the intermediate section;

first means for electrically interconnecting the first and second power input terminals with the first end sections of the first and second power conductors, respectively.

second means for electrically interconnecting the intermediate sections of the first and second power conductors with the smaller speaker such that the power conductors are connected to transmit electrical power to drive the smaller speaker;

said first and second power conductors rigidly supporting the smaller speaker over the larger speaker to prevent excessive movement and vibration of the smaller speaker.

12. The invention of claim 11 wherein each of the support sections is covered with a respective thin layer of plastic.

13. The invention of claim 11 wherein each of the support sections is covered with a coating.

14. The invention of claim 11 wherein the first and second means each comprise a respective lug secured to the respective sections of the power conductors.

15. In a loudspeaker of the type comprising a first, larger speaker including a larger frame, a second, smaller speaker including a smaller speaker support structure, and first and second power input terminals, the improvement comprising:

first and second rigid, electrically conductive bridge sections;

means for rigidly mounting the bridge sections to the larger frame;

means for rigidly mounting the smaller speaker support structure to the bridge sections such that the bridge sections rigidly support the smaller speaker in place in front of the larger speaker;

means for electrically insulating the first and second bridge sections from one another;

means for electrically interconnecting the bridge sections with respective ones of the power input terminals; and means for electrically interconnecting the bridge sections with the smaller speaker such that the smaller speaker is powered by electrical current flowing through the bridge sections.

16. The invention of claim 15 wherein the bridge sections provide the only structural support for the smaller speaker.

17. The invention of claim 15 wherein the bridge sections are formed from respective sheet metal elements.

18. The invention of claim 15 wherein each of the bridge sections extends completely across the larger frame, wherein the smaller speaker support structure is mounted to intermediate portions of the bridge sections, and wherein the bridge sections extend alongside of and generally parallel to one another.

19. The invention of claim 18 wherein the insulating means comprises an insulating grille which extends over the smaller speaker and comprises at least one rib which extends between the bridge sections.

20. The invention of claim 15 wherein each of the bridge sections defines a first end rigidly mounted to the larger frame and a second end rigidly mounted to the smaller speaker support structure such that the smaller speaker rigidly interconnects the bridge sections.

21. The invention of claim 20 wherein the insulating means comprises an insulating grille which extends over the smaller speaker and comprises at least one rib which extends between the bridge sections.

* * * * *